United States Patent [19]

Pietraszek et al.

[11] Patent Number: 4,548,189

[45] Date of Patent: Oct. 22, 1985

[54] ARROW RESTS USED IN ARCHERY

[76] Inventors: Mitchell E. Pietraszek, 735 Saylor, Elmhurst, Ill. 60426; Myron J. Rutledge, R.R. 3 Box 178, Oswego, Ill. 60543

[21] Appl. No.: 420,850

[22] Filed: Sep. 21, 1982

[51] Int. Cl.[4] ..... F41B 5/00

[52] U.S. Cl. ..... 124/41 A; 124/24 R

[58] Field of Search ..... 124/24 R, 41 A, 88

[56] References Cited

U.S. PATENT DOCUMENTS

| | | | |
|---|---|---|---|
| 2,786,461 | 3/1957 | Pelsue | 124/41 B X |
| 3,342,173 | 9/1967 | Ferguson | 124/41 B X |
| 3,739,765 | 6/1973 | Moore | 124/41 B X |
| 3,871,352 | 3/1975 | Stanislawski et al. | 124/24 R X |
| 4,133,334 | 1/1979 | Tone | 124/24 R X |
| 4,343,286 | 8/1982 | Thacker | 124/41 B X |

*Primary Examiner*—Richard J. Apley
*Assistant Examiner*—William R. Browne
*Attorney, Agent, or Firm*—Edmond T. Patnaude

[57] ABSTRACT

An arrow rest has an L-shaped bracket for mounting the arrow rest to a bow. A ferromagnetic wire rest member is pivotalably attached to the bracket and is biased into the operative rest position. A permanent magnet permits the rest pin to be deflected from the operative position by the fletches of an arrow passing across the rest pin.

5 Claims, 7 Drawing Figures

ARROW RESTS USED IN ARCHERY

The magnetically operated arrow rest has been devised to improve the flight of an arrow, propelled by a bow. Normally, an arrow is rested upon some device attached to the bow, prior to release of the arrow. As the released arrow passes over the device, the fletching (feathers or plastic vanes) touch the rest device causing the arrow to be deflected and wobble in flight.

Our magnetically operated arrow rest effectively eliminates this arrow wobble problem by providing a pivoting, magnetically positioned pin, on which to rest the arrow. The pin can pivot out of the way of the fletching with no disturbance to the moving arrow.

The object of our invention is to provide superior arrow flight by using a magnetically operated pivoting pin on which to rest an arrow.

Our invention is mounted, using a threaded rod and nut, or a cushion plunger (another commercially produced archery aid) on the bow. An arrow is strung onto the bow and rested on the magnetically positioned arrow rest pin; the arrow is then drawn back. The operator of the bow releases the drawn bow and the arrow is propelled forward. The fletching (feathers or vanes) touche the pin, causing the pin to pivot out of the way. After the arrow passes, the magnet repositions the pin for the next firing.

Furthermore, our invention is so designed that it can be used easily with most any bow currently being produced.

Magnets have been used before in conjunction with arrow rests. The Bear company, approximately 10 years ago, used the principle on one of their bows. However, their magnetically operated arrow rest could be used only with their bow. Our invention is independent of the bow, therefore, uniquely different. Other attempts at using magnets in arrow rests have been made. However, the type of magnet, and the manner in which the magnets were used is different and inferior to our invention. In addition, these other magnetically operated arrow rests cannot be conveniently used with all bows on the market, nor can they be properly adjusted and used with all bows. They may also protrude excessively, due to the fact that only a single mounting hole is provided. This makes them vulnerable to being bumped and misaligned. Our arrow rest has a mounting slot, thereby allowing our arrow rest to be mounted on any bow as snuggly as the operator wishes and can be adjusted properly.

Other possible attempts at producing a magnetically operated arrow rest use a bracket with a drilled hole in which the arrow rest pin (wire) rides. This concept makes the device nearly impossible to commercially produce as the rest pin wire must be bent after insertion in the drilled hole. This will also lead to problems in that, if the wire rest pin rusts, it will bind, and cannot be cleaned. However, our arrow rest uses a clamp to hold the wire rest pin. This makes our arrow rest producible in quantity, and allows the owner to remove the wire rest pin for cleaning, if necessary.

Figure 4:
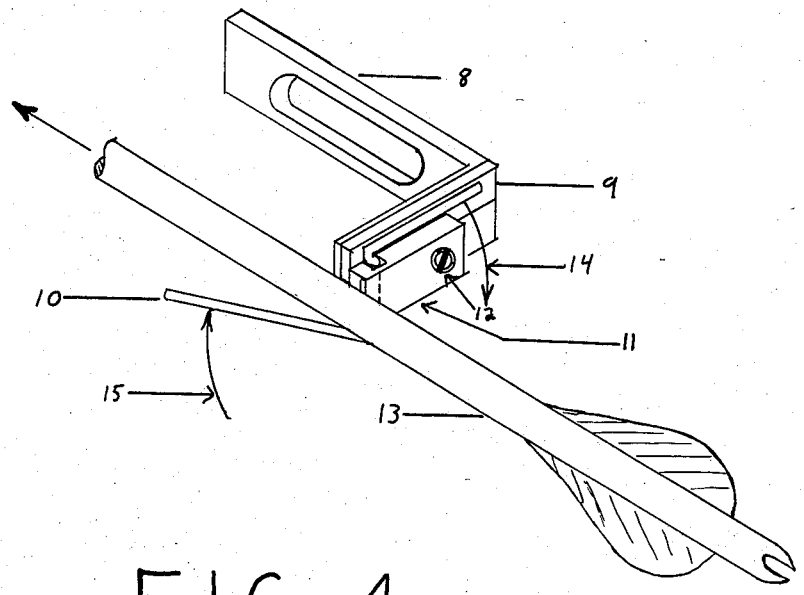

FIG. 4 drawing of the assembled arrow rest supporting an arrow.

Figure 5:
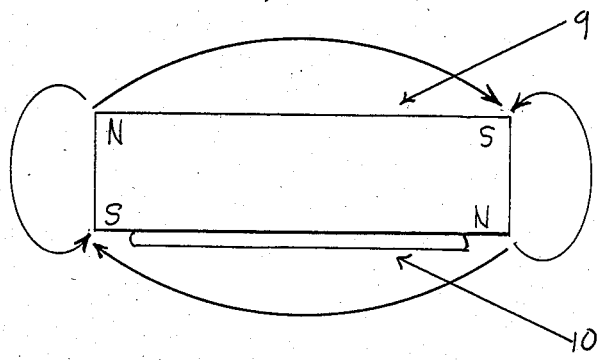

FIG. 5 drawing of the magnetic poles of the barrium ferrite magnet used on the arrow rest.

Figure 1:
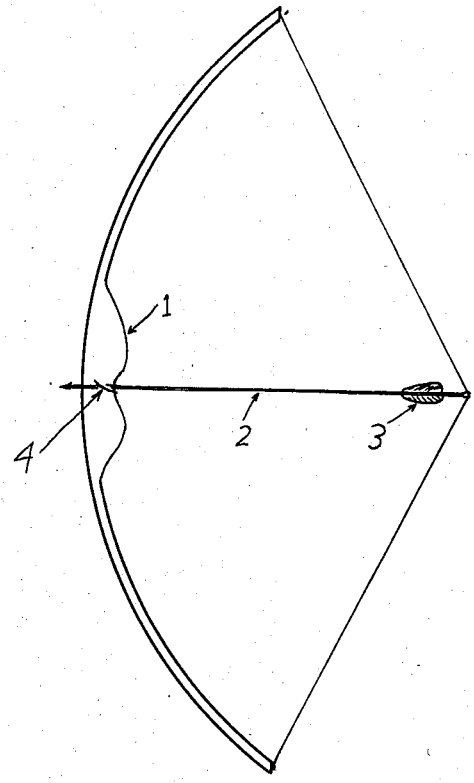
FIG. 1 shows a bow with a drawn arrow and the relative position of the arrow rest.

FIG. 1 is given to show a proper perspective of how our magnetically operated arrow rest relates to a bow and arrow.

Figure 2A:
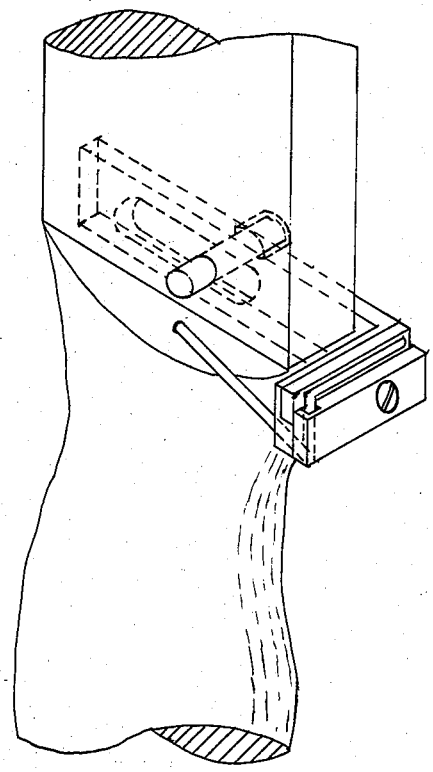
FIG. 2 shows how the arrow rest mounts to a bow.
Figure 2B:
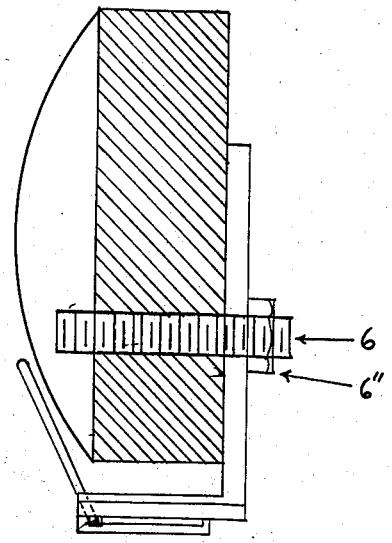
Figure 2C:
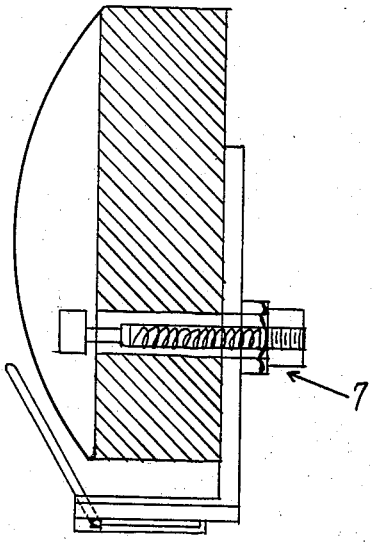

FIG. 2 gives a view of the relative mounting positions on a typical bow handle. FIGS. 2B and 2C are cross-sectional views showing how our magnetically operated arrow rest is secured to a bow. FIG. 2B shows a threaded rod (6), threaded into the 5/16-24 threaded hole provided by the manufacturer of the bow. Our arrow rest is then slipped onto the bolt (6), adjusted for fit by sliding back and forth, then secured by a nut (6″). Many archers use a cushion plunger (7) FIG. 2C in the 5/16-24 tapped hole instead of a simple threaded rod. In this case, our arrow rest is simply secured by the nut on the cushion plunger assembly.

The assembly of our arrow rest proceeds as follows: In this discussion, all references are to FIG. 3, the scale of the drawing is approximately 2 times the actual size.

The barrium ferrite magnet (9) is glued to the aluminum bracket (8). The arrow rest pin (10) is slipped into the square slot (11″) in the clamp (11). The clamp (11), with the pin (10) in the slot, is then attached to the bracket (8), using a 4-40 by ¼ inch screw (12). Prior to tightening the ¼ inch 4-40 screw (12), the clamp should be pivoted on the 4-40 screw (12), to minimize vertical play in the arrow pin (10). The clamp (11) should be adjusted just about short of binding the arrow rest pin (10) against the bracket (8). The 4-40 screw (12) is then tightened to secure the clamp (11).

Figure 3:
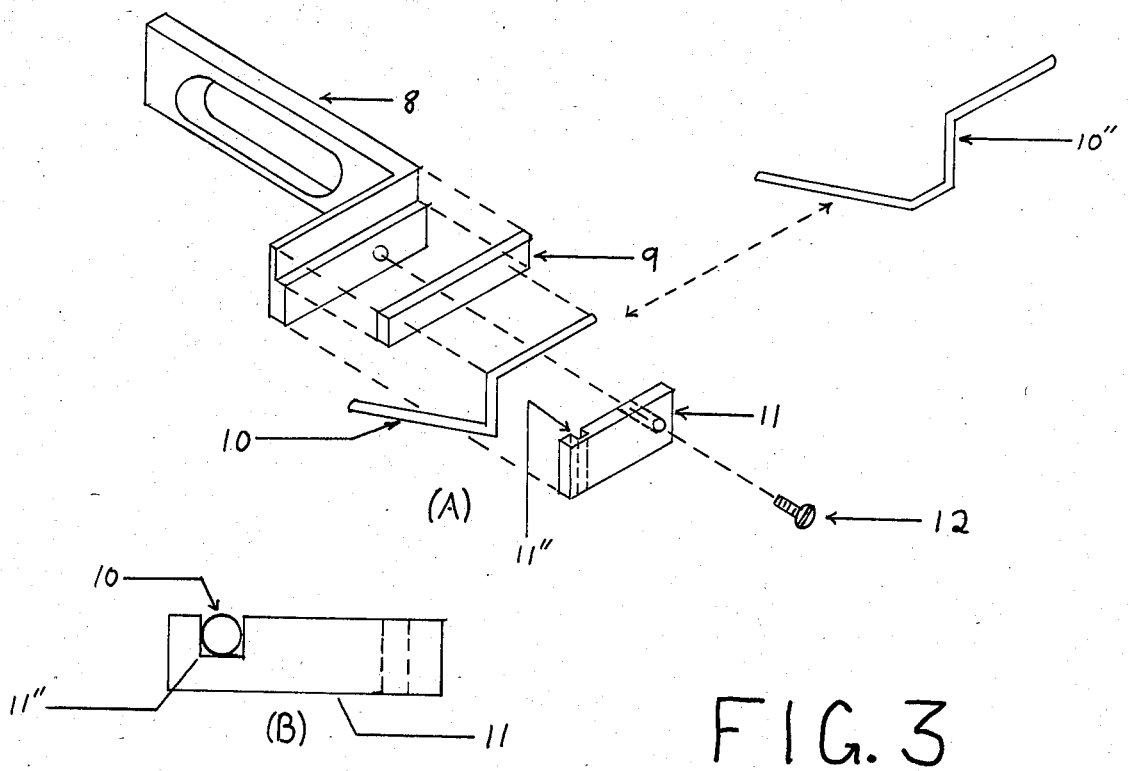
FIG. 3 is an assembly drawing of the arrow rest.

Shown also in FIG. 3 is an optional wide reach arrow rest pin (10″). The standard arrow rest pin is intershown with the standard arrow rest pin (10). We offer this option to accommodate various types of bows whose handles require a wider reach arrow rest pin.

FIG. 3B details the manner in which the round cross section arrow rest pin (10) rides in the square slot of the clamp (11), providing a collection area for foreign matter or rust which may occur. This collection area insures reliable operation with no malfunction due to binding.

The only parts in the assembly which are critical are the wire pin (10), and the slot in the clamp (11) in which the arrow rest pin rides. The specifications for these parts are: arrow rest pin (10) must be of music wire and be $0.065 \pm 0.0005$ inches in diameter. The slot in the clamp (11) must be $0.064 \pm 0.001$ inches by $0.064 \pm 0.001$ inches.

The dynamic operation of our magnetically operated arrow rest is as follows: The following discussion refers to FIG. 4. An arrow (13) is strung onto the bow and rested on the arrow rest pin (10). The magnet (9) holds the arrow rest pin (10) securely while the bow and arrow is being drawn back. When the arrow is propelled forward by the bow, the arrow rest pin (10) is held in the support position until the fletching of the moving arrow (13) touches the arrow rest pin (10). The force of the fletching on the arrow (13) rest pin (10) overcomes the holding force of the magnet (9) on the other end of the arrow rest pin (10) and the magnet releases the arrow rest pin. The pin is now free to pivot as shown by arrows 14 and 15. After the arrow has passed, the magnet (9) again has sufficient force to attract and hold the pin allowing another arrow to be rested upon the arrow rest pin and the action repeated.

FIG. 5 is a top view showing how the arrow rest pin (10) is positioned in relation to the barium ferrite magnet. This view shows the arrow rest pin in position to support an arrow.

We claim:

1. An arrow rest for a bow, comprising in combination a non-magnetic bracket member having first and second orthogonally disposed legs, said first leg being apertured to receive means for attaching said bracket member to a bow, a permanent magnet in the shape of a regular hexahedron, means for mounting said magnet to said second leg of said bracket member, an arrow rest pin formed of a magnetic material and having a straight intermediate portion, a non-magnetic clamp member affixed to said second leg, said clamp member having a rectilinear groove extending in a vertical direction when a bow is in a vertical position, said intermediate portion of said rest pin being cylindrical and pivotably positioned in said groove, said second leg extending across said groove to retain said pin in said groove, said rest pin having an arrow rest portion adjacent one end of said intermediate portion and lying in a plane perpendicular to the longitudinal axis of said intermediate portion of said pin, and said rest pin having a magnet engaging portion adjacent the other end of said intermediate portion, said magnet engaging portion being straight and adapted to be juxtaposed with one face of said magnet when said rest pin is oriented with said rest portion lying in the horizontal plane while a bow is in the vertical plane.

2. An arrow rest according to claim 1 wherein said intermediate portion of said rest pin is disposed against said one face of said magnet.

3. An arrow rest according to claim 1 wherein said magnet is secured to said second leg by means of an adhesive.

4. An arrow rest according to claim 3 wherein said second leg is provided with an elongated groove, said magnet is located in said groove, and said clamp member partially overlies said magnet.

5. An arrow rest according to claim 4 wherein said arrow rest portion of said rest pin is shaped so that when said magnet automatically pulls said magnet engaging portion into engagement with said one face of said magnet when said rest portion is in an extended arrow rest position.

* * * * *